US007737845B2

(12) United States Patent
Fawcett et al.

(10) Patent No.: US 7,737,845 B2
(45) **Date of Patent: *Jun. 15, 2010**

(54) PROGRAMMABLE KEY FOR A SECURITY SYSTEM FOR PROTECTING MERCHANDISE

(75) Inventors: Christopher J. Fawcett, Charlotte, NC (US); Ronald M. Marsilio, Lake Wiley, SC (US); Ian R. Scott, Duluth, GA (US)

(73) Assignee: Invue Security Products Inc., Charlotte, NC (US)

( * ) Notice: Subject to any disclaimer, the term of this patent is extended or adjusted under 35 U.S.C. 154(b) by 504 days.

This patent is subject to a terminal disclaimer.

(21) Appl. No.: 11/639,100

(22) Filed: Dec. 14, 2006

(65) Prior Publication Data

US 2008/0012684 A1 Jan. 17, 2008

Related U.S. Application Data

(60) Provisional application No. 60/753,630, filed on Dec. 23, 2005.

(51) Int. Cl.
*G08B 13/14* (2006.01)

(52) U.S. Cl. ..... 340/568.2; 340/5.25; 340/693.5; 340/815.45

(58) Field of Classification Search ..... 340/568.2, 340/568.1, 568.8, 572.1, 693.5, 691.1, 815.45, 340/5.25

See application file for complete search history.

(56) References Cited

U.S. PATENT DOCUMENTS

| | | | | |
|---|---|---|---|---|
| 3,493,955 | A | | 2/1970 | Minasy |
| 4,573,042 | A | | 2/1986 | Boyd et al. |
| 4,686,513 | A | | 8/1987 | Farrar et al. |
| 4,800,369 | A | | 1/1989 | Gomi et al. |
| 4,851,815 | A | | 7/1989 | Enkelmann |
| 4,853,692 | A | | 8/1989 | Wolk et al. |
| 4,926,665 | A | * | 5/1990 | Stapley et al. ..... 70/277 |
| 4,980,671 | A | | 12/1990 | McCurdy |
| 5,005,125 | A | | 4/1991 | Farrar et al. |
| 5,182,543 | A | | 1/1993 | Siegel et al. |
| 5,245,317 | A | | 9/1993 | Chidley et al. |
| 5,367,289 | A | | 11/1994 | Baro et al. |
| 5,570,080 | A | | 10/1996 | Inoue et al. |

(Continued)

FOREIGN PATENT DOCUMENTS

JP 8279082 10/1996

*Primary Examiner*—Thomas J Mullen
(74) *Attorney, Agent, or Firm*—Christopher C. Dremann, P.C.

(57) ABSTRACT

A programmable key for use in a security system for protecting items of merchandise has a housing, a power supply mounted in the housing, a logic control circuit which includes a controller, a wireless communication circuit and a security disarm code (SDC) memory. The key has visual indicators such as an LED which is operatively connected to the logic control circuit and pulsed to indicate the state of the SDC. The control circuit includes a timer which has a preset time limit programmed therein, which invalidates the stored SDC if not refreshed by a remote programming source within a certain time period. The logic circuit further includes a counter which counts the number of activations of a control switch, and which permanently deactivates the control circuit upon reaching a certain count value to ensure that the internal battery has sufficient power to maintain the key operational. The wireless communication circuit preferably is infrared (IR) or radio frequency (RF) controlled.

18 Claims, 6 Drawing Sheets

U.S. PATENT DOCUMENTS 5,589,819 A 12/1996 Takeda
5,610,587 A 3/1997 Fujiuchi et al.
5,640,144 A 6/1997 Russo et al.
5,656,998 A 8/1997 Fujiuchi et al.
5,701,828 A * 12/1997 Benore et al. ..... 70/278.2
5,764,147 A 6/1998 Sasagawa et al.
5,767,773 A 6/1998 Fujiuchi et al.
5,793,290 A 8/1998 Eagleson et al.
5,808,548 A 9/1998 Sasagawa et al.
5,838,234 A 11/1998 Roulleaux-Robin
5,864,290 A 1/1999 Toyomi et al.
5,955,951 A 9/1999 Wischerop et al.
5,982,283 A 11/1999 Matsudaira et al.
6,020,819 A 2/2000 Fujiuchi et al.
6,037,879 A 3/2000 Tuttle
6,043,744 A 3/2000 Matsudaira
6,104,285 A 8/2000 Stobbe
6,118,367 A 9/2000 Ishii
6,137,414 A 10/2000 Federman
6,144,299 A 11/2000 Cole
6,255,951 B1 7/2001 De La Huerga
6,275,141 B1 * 8/2001 Walter ..... 340/5.64
6,304,181 B1 10/2001 Matsudaira
6,346,886 B1 2/2002 De La Huerga
6,384,711 B1 * 5/2002 Cregger et al. ..... 340/5.65
6,420,971 B1 7/2002 Leck et al.
6,433,689 B1 8/2002 Hovind et al.
6,474,117 B2 11/2002 Okuno
6,512,457 B2 1/2003 Irizarry et al.
6,531,961 B2 3/2003 Matsudaira
6,535,130 B2 3/2003 Nguyen et al.
6,961,000 B2 11/2005 Chung
7,102,509 B1 9/2006 Anders et al.
2002/0024440 A1 2/2002 Okuno
2003/0058083 A1 * 3/2003 Birchfield ..... 340/5.22

* cited by examiner

SDC – Secure Disarming Code
MFG – Manufacturing
SW – Switch
CFG – Configuration
Comm I/F – Communications Interface
EAS – Electronic Article Surveillance
AU – Alarm Unit
PS – Programming Station
EOL – End of Life
INIT – Initialize
NP – Not Programmed
ACT SW – Activation Switch
NON–VOL – Non–Volatile
B&F – Beep and Flash
A&F – Alarming and Flashing
SN – Sense

PROGRAMMABLE KEY FOR A SECURITY SYSTEM FOR PROTECTING MERCHANDISE

CROSS REFERENCE TO RELATED APPLICATIONS

This application claims priority from U.S. Provisional Application Ser. No. 60/753,630 filed Dec. 23, 2005; the disclosure of which is incorporated herein by reference.

BACKGROUND OF THE INVENTION

1. Technical Field

The invention relates to security devices, systems and methods for protection of merchandise, and in particular, a programmable smart key for use in a security system wherein the key is programmed with a security disarm code (SDC) at a programming station and is used to program the SDC code into various alarm modules adapted to be attached to items of merchandise by wireless communication.

2. Background Information

Various retail establishments use numerous types of theft deterrent devices and systems to discourage shoplifters. Many of these systems use various types of alarm modules or other security devices which are attached to the article to be protected in one manner or another. When the integrity of the module or the item of merchandise protected thereby is compromised in any manner, such as cutting the attachment cables which attach the alarm module to the item of merchandise, removing the merchandise from the alarm module or disturbing the alarm module, will cause an audible alarm to be sounded in the module to alert store personnel that the item of merchandise or security device is being tampered with illegally. These alarm modules, as well as the items of merchandise protected thereby, also may contain various electronic article surveillance tags (EAS) which will sound an alarm at a security gate upon passing through the gate in an unauthorized manner.

These alarm modules or security devices which are attached to the items of merchandise usually have some type of key, either mechanical or magnetic, which is used to unlock the device from the protected item of merchandise to enable the merchandise to be taken to a checkout counter, as well as to disarm an alarm contained in the alarm module. One problem with such security systems is that these keys will be stolen from the retail establishment and used at the same establishment or at another store using the same type of alarm module or security device, to enable a thief to disarm the alarm module as well as unlock it from the protected merchandise. These keys also are stolen by dishonest employees for subsequent unauthorized use by the employee or sale to a thief for use at the same store or at other stores which use the same alarm modules controlled by the key.

It is extremely difficult to prevent the theft of these keys by dishonest employees or even by a thief within the retail establishment due to the number of keys that must be available and used by the various clerks in the various departments of the store to facilitate the use of the numerous alarm modules and security devices that are needed to protect the numerous items of merchandise.

Thus, the need exists for a security system and in particular a disarming key used thereon, which system uses various types of alarm modules and security devices which are attached to various items of merchandise, which will prevent a thief or dishonest employee from using the key that is used to disarm and unlock the security device in an unauthorized manner on similar types of alarm modules and security devices at various retail establishments including the store from which the key was stolen.

BRIEF SUMMARY OF THE INVENTION

One aspect of the present invention is to provide a security system for protecting items of merchandise, and in particular a key used therein for disarming and unlocking the security device from the merchandise, which key is programmable with a unique security disarm code (SDC), which code is provided to the key by a programming station, wherein the SDC is unique to a particular retail establishment thereby preventing the key to be used at a different store than that from which the key is stolen.

A further aspect of the present invention is to use the key in which the SDC is programmed to program each of the individual alarm modules or security devices with the same SDC when the alarm modules and devices are first activated, which enables the SDC to remain with the security device throughout its use in the particular retail establishment for subsequent matching with the SDC stored in the key.

Another aspect of the present invention is to provide the smart key with an internal timer which after a preset period of time, for example 96 hours, will automatically invalidate the SDC in the key thereby preventing its unauthorized use even in the particular retail establishment in which the programming station is located and SDC protected security devices are used, after the preset time period.

A further feature of the present invention is that the smart key must be reprogrammed with the SDC after a preset time period, which can be performed by authorized personnel, insuring that the key can only be used by authorized clerks, and only in the store having a programming station and a single SDC for all of the security devices in the store.

Still another aspect of the present invention is to provide the key with a wireless communication circuit for receiving the SDC from a programming station and subsequently transferring the SDC into the security device.

Another feature of the present invention is to provide the smart key with an internal counter which counts the number of activations performed by the key, that is, the initial activation of every security device in the store as well as each time the key is used to disarm one or more of the security devices, and upon a predetermined number of activations occurring will permanently inactivate the key thereby ensuring that an active key always has sufficient internal power to receive the SDC and subsequently communicate with the individual security devices for disarming the devices when required.

A further feature of the present invention is to enable the internal counter to actuate an indicating signal a predetermined time period before permanently deactivating the control circuit after the maximum number of activations have been provided by the key.

A still further aspect of invention is to enable the security device to actuate an alarm if the key is attempted to be used to disarm the security device containing a wrong SDC.

Still another aspect of the invention is to provide the key with a visual indicator which is operatively connected to an internal logic control circuit and is pulsed to indicate the state of the SDC stored therein.

A further feature is to provide the key with a wireless communication circuit, such as infrared (IR) or radio frequency (RF), for programming the SDC into a security device; and in which the key is provided with a visible light filter to enhance the transmission and reception of IR waves when the wireless communication is an IR circuit.

Another feature of the invention is that should a key programmed with an SDC from one store be used in a programming station of another store, the time-out feature will immediately be activated removing the SDC from the key rendering it inactive from further use.

These features are obtained by the programmable key of the present invention which is intended for use in a security system for protecting items of merchandise, the key comprising a housing; a power supply mounted in the housing; a logic control circuit including a controller, a wireless communication circuit and a security disarm code (SDC) memory mounted in the housing and connected to the power supply by a control switch, wherein the controller initially receives an SDC from a remote source through the wireless communication circuit for storage in the SDC memory and for subsequent transmission of the SDC code by the wireless communication circuit to a security device adapted to be attached to an item of merchandise upon actuation of the control switch.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
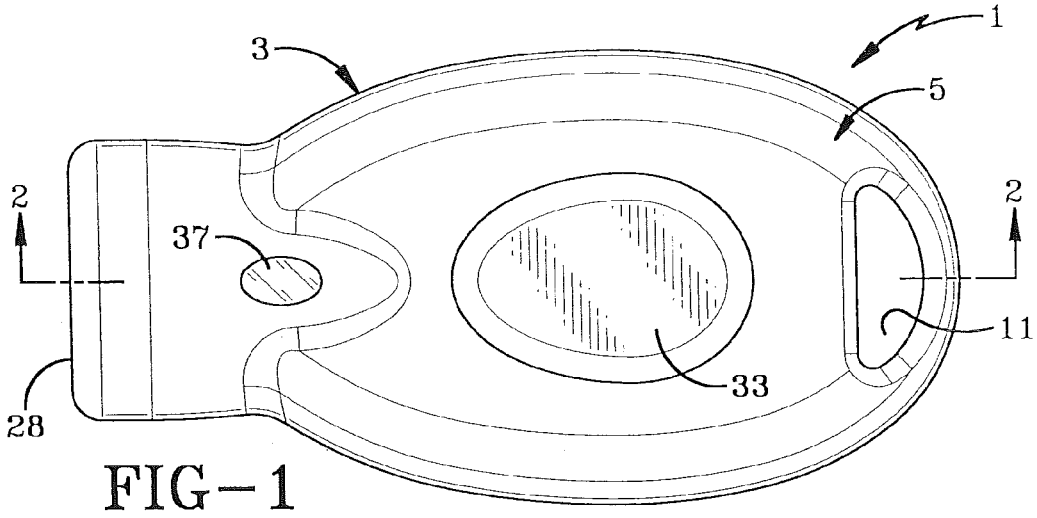
FIG. 1 is a top plan view of the key of the present invention.
Figure 2:
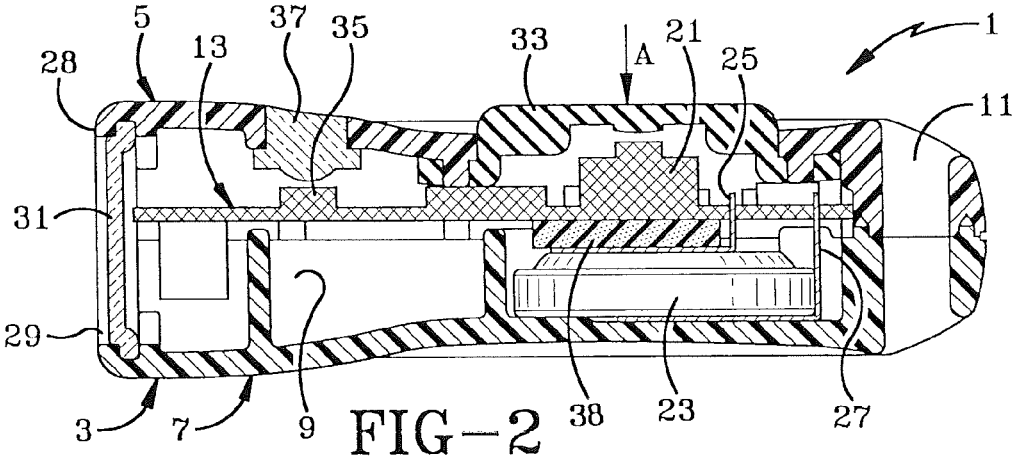
FIG. 2 is a sectional view taken along line 2-2, FIG. 1.

The programmable key of the present invention is indicated generally at 1, and is shown particularly in FIGS. 1 and 2. Key 1 preferably includes a housing indicated generally at 3, formed by an upper housing member 5 and a lower housing member 7 which can be joined together by an adhesive, ultrasonic weld or other type of connection, and which form an internal chamber 9 therein. Housing members 5 and 7 preferably are formed of a rigid plastic and may have a generally oval-like configuration as shown in FIG. 1, and form an opening 11 at one end thereof to provide a convenient location for attaching a chain, lanyard or the like to assist in maintaining control of the key while in use or in storage by a clerk or store manager.

Figure 3:
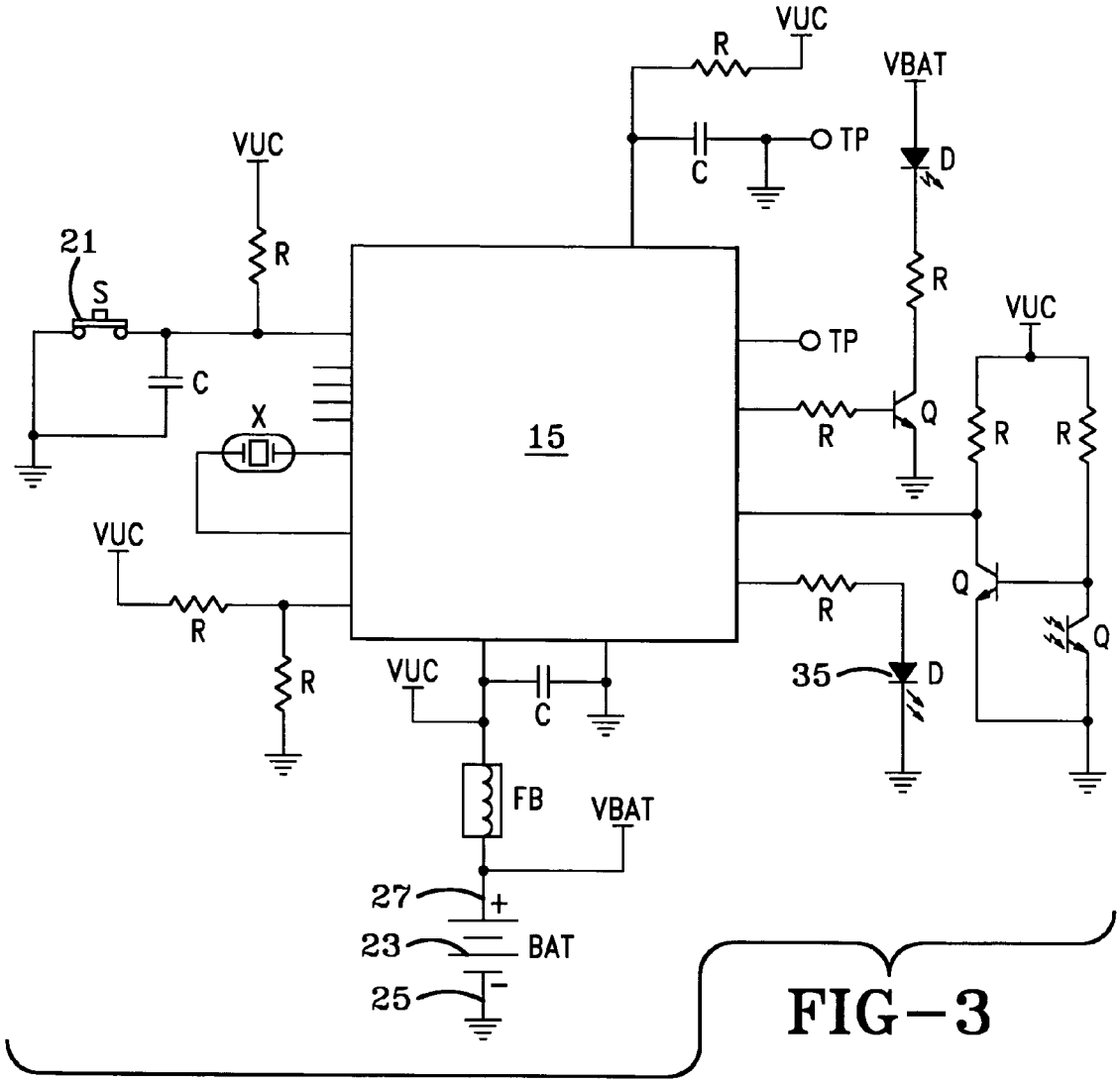
FIG. 3 is the electrical circuit schematic of the logic control circuit of the programmable key of the present invention.

In accordance with one of the main features of the invention, a logic control circuit is formed on a printed circuit board 13 and is located within housing chamber 9. The logic control circuit includes a main controller, which preferably is a microprocessor 15, a security disarm code (SDC) memory 17, a wireless communication circuit 19 and an activation switch 21. The details of the various circuitry is shown in FIG. 3. The logic control circuit is powered by an internal battery 23 which is located beneath circuit board 13 within housing 3, and is in electrical contact therewith by terminals 25 and 27. The opposite end 28 of housing 3 is formed with an opening 29 in which is mounted a lens 31, which preferably will be a visible light filter to enhance the transmission and reception of infrared (IR) waves when the wireless communication circuit 19 is an IR circuit operating on IR wavelengths. The use of infrared as the communication media is preferred, although radio frequency wave communications and other types of wireless communication can be used to achieve the same effect. Switch 21 is covered by a flexible member 33, which when pressed downwardly as shown by Arrow A, FIG. 2, will compress sufficiently to actuate internal switch 21.

An LED 35 is mounted on printed circuit board 13 and is located adjacent a light pipe 37 mounted in upper housing 5, to enhance the visual effect of LED 35 when actuated. A foam pad 38 preferably is located between battery 23 and printed circuit board 13 and secures battery 23 in position, as well as providing cushioning for the circuit board and maintains its spacing and location within housing chamber 9.

Figure 5:
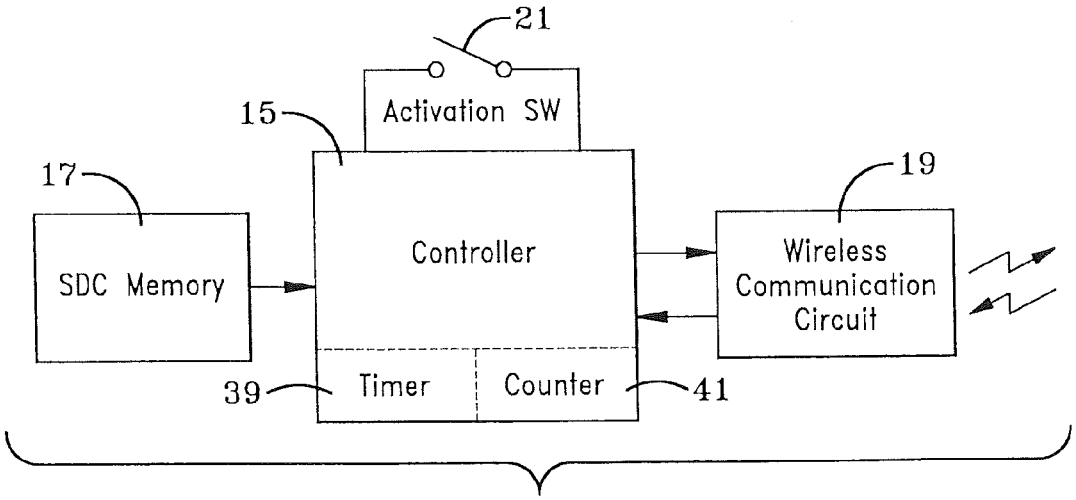
FIG. 5 is a block diagram of the programmable key.
Figure 4:
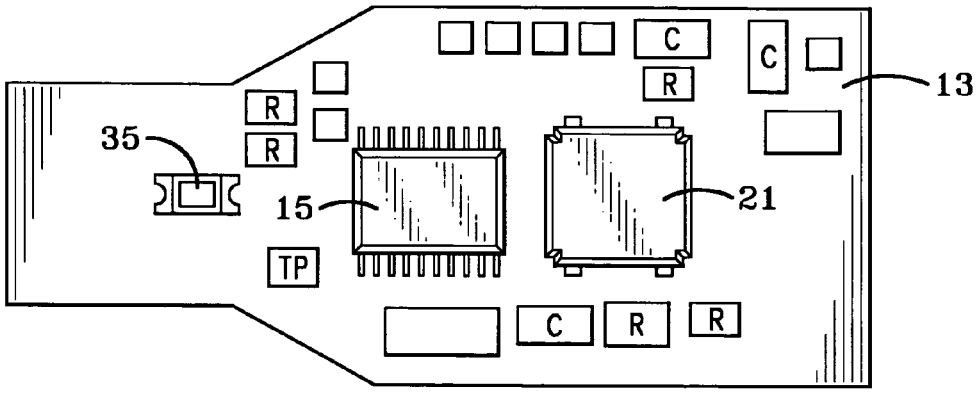
FIG. 4 is a top plan view of the circuit board of the programmable key.

Controller 15 includes as a feature thereof a timer shown diagrammatically for illustrative purposes as block 39 in FIG. 5, and a lifetime counter shown diagrammatically in FIG. 5 and indicated at 41, the functions of which are discussed below. FIG. 4 shows an example of printed circuit board 13 which will contain controller 15, switch 21, and various resistors R and capacitors C which are shown in further detail in FIG. 3.

It is readily understood that the particular circuitry shown in FIG. 3 and the values of the various resistors, capacitors, diodes, etc. are easily determined by one skilled in the art and can vary while providing the main principles and features of the invention.

Figure 7:
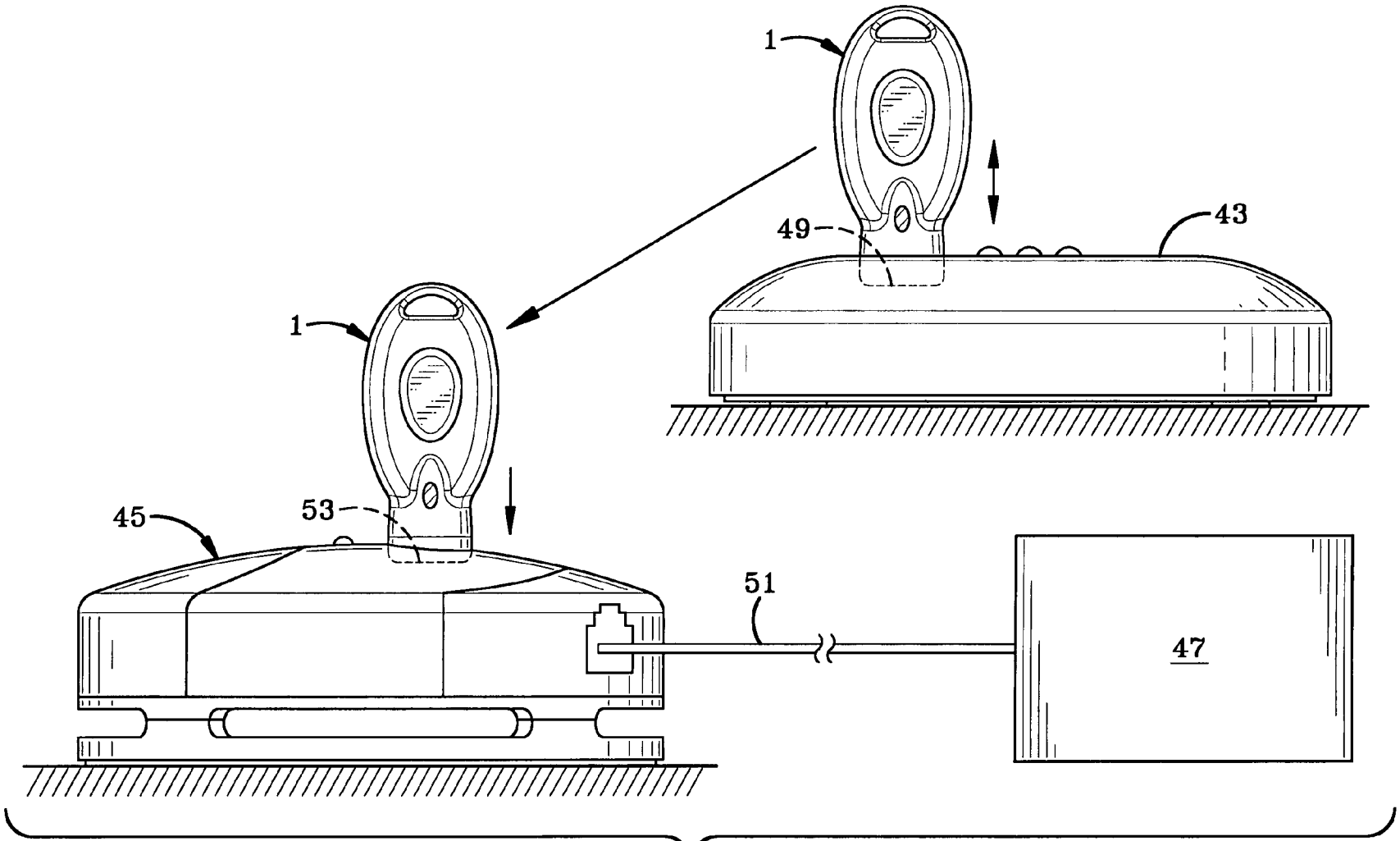
FIG. 7 is a diagrammatic representation of one type of security system in which the key of the present invention can be used.

Key 1 is intended to be used primarily in a security system for protecting items of merchandise such as shown and described in a copending patent application entitled, Security System And Method For Protecting Merchandise, filed concurrently herewith, and shown diagrammatically in FIG. 7. This security system includes a programming station 43 such as shown and described in copending patent application entitled, Programming Station For A Security System For Protecting Merchandise, and numerous security devices 45 which are connected to items of merchandise 47 by an alarm cable 51 or other attachment device to prevent the theft thereof. Examples of such security devices are shown and described in a copending patent application concurrently filed herewith entitled, Programmable Alarm Module And System For Protecting Merchandise. The particular details, construction and manner of operation of the security system, programming station 43 and security device 45 are shown and described in the said pending applications, the contents of which are incorporated herein by reference.

Key 1, when supplied to a retail establishment, preferably will not contain any coded information and will obtain the same by communicating with the circuitry of programming station 43 via wireless communication circuit 19. This is accomplished by placing housing end 28, and particularly lens 31, adjacent a wireless communication port 49 in programming station 43, and upon actuation by depressing button 21, will receive a randomly generated security disarm code (SDC) from programming station 43. Once generated by programming station 43, this SDC preferably will always remain the same throughout the useful life of key 1. This SDC is received and stored in SDC memory 17 of the control logic circuit of key 1. Key 1 is then taken by a clerk to a security device 45, which could be an alarming module or other type of device, which is connected to merchandise 47 by a cable 51, flexible conductor or other type of lanyard which preferably includes a sensing loop which will prevent the removal of merchandise 47 therefrom and/or will cause an alarm to be sounded in security device 45 if the integrity thereof is compromised. The particular form and type of security device 45 can vary considerably from that shown in the above referenced pending patent application without affecting the concept of the invention. Key 1 is then placed in a wireless communication port 53 formed in security device 45. Switch 21 is again activated, and communication circuit 19 will transmit the previously stored SDC from key 1 into an SDC memory contained in a logic circuit of security device 45.

Upon key 1 acquiring the SDC from programming station 43, it will start internal timer 39 which has been preset at the factory, for example 96 hours, which through the control logic circuit will automatically invalidate the SDC contained therein, unless refreshed within the preset time period, thereby making the key inoperative for further use even by authorized personnel. This prevents the key from being stolen and then subsequently reused in the same store after this preset time period, and even more importantly, since the SDC is unique only to that store, the key cannot be taken to another store even using the same type of security system and security devices, and be used in an unauthorized manner since the SDC contained therein will not match the SDC previously stored in the security devices of a different store. Thus, a store clerk after the key has been programmed with the SDC initially or revitalized within the time period by placing it in wireless communication with programming station 43, can use it with the security devices 45 to either disarm an alarm contained in the security device and/or activate a lock mechanism etc. to enable the security device to be disarmed or unlocked or removed from a protected item of merchandise for completing a lawful sales transaction.

Each time button 21 is activated, counter 41 will record the actuation. The logic circuit has been preset at the factory in combination with counter 41, that after a certain number of activations, for example 55,000, the logic circuit will completely shut down and forever be inoperative. This is referred to as an "end-of-life" counter and it begins counting on the first receipt of the actuation of switch 21 and all subsequent activations thereof. This end-of-life counter ensures that battery 23 always has sufficient power for operating the SDC memory and wireless communication circuitry of key 1 before losing its charge to be ineffective. This prevents using key 1 beyond its useful life. However timer 39 will be automatically reset each time key 1 is brought into communication with the SDC programmer of station programmer 43.

Figure 6:
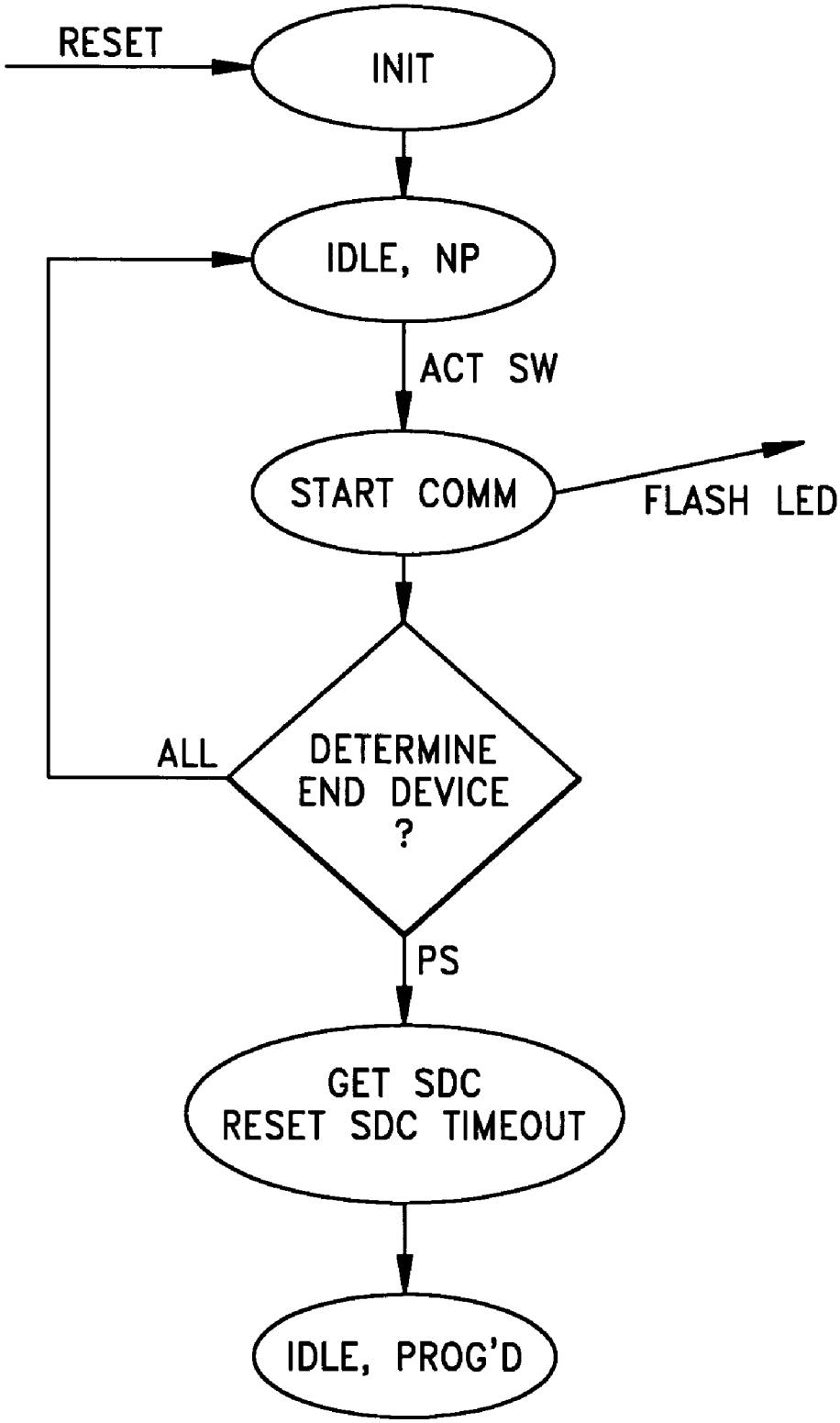
FIGS. 6, 6A and 6B are flow charts showing the manner of operation of the programmable key.
Figure 6A:
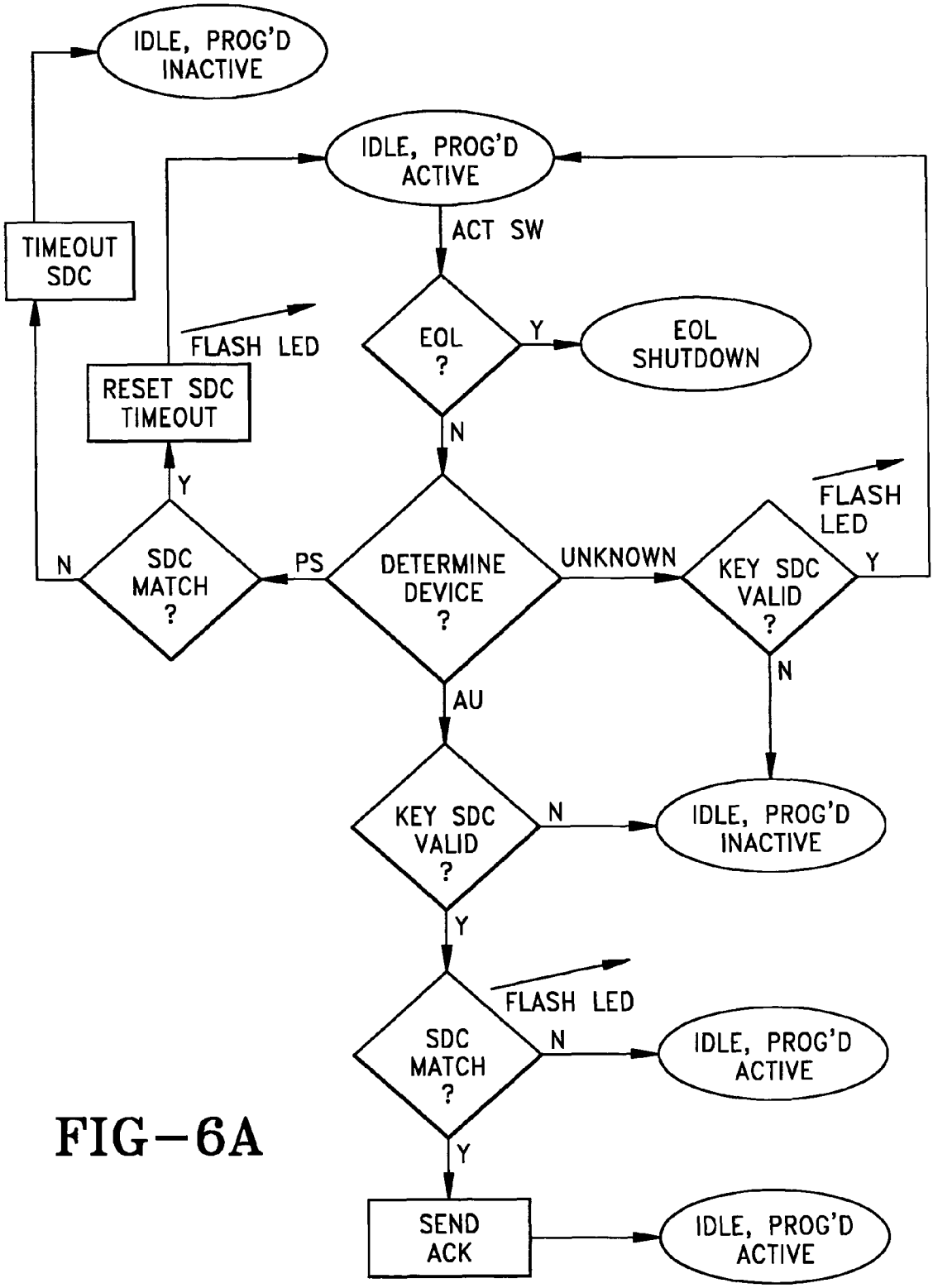
Figures 6B, 6C:
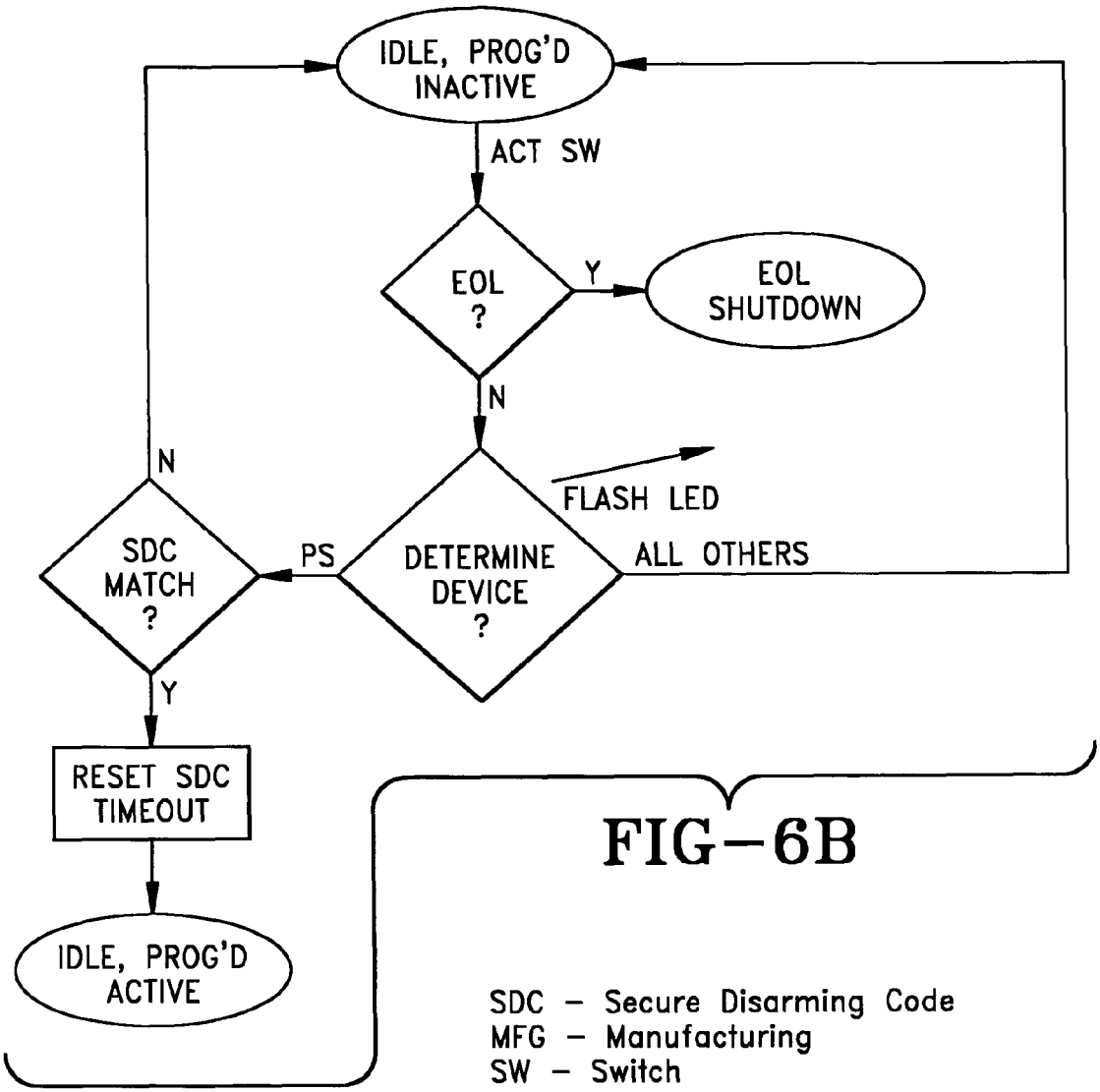
FIG. 6C is a list of the abbreviations used in the flow charts of FIGS. 6, 6A and 6B.

FIG. 6A and FIG. 6B are the flow charts describing the sequence of operation that the control logic circuit follows when switch 21 is actuated and the key is located adjacent to the wireless communication port 49 of programming station 43 and near communication port 53 of security device 45. The flow charts show the effect that occurs if timer 39 has exceeded its time limit and deletes the SDC from a key and what could occur if end-of-life counter 41 has reached the preset number of activations. The flow charts also show that LED 35 will flash at various times to provide various signals, such as when the button is initially pressed to reset the SDC after it is timed out, as well as when it confirms the match with the SDC stored in the security device. For example, LED 35 will flash one time when switch 21 is depressed indicating that the key is operational, but that it has no SDC programmed therein. LED 35 will flash twice when switch 21 is depressed indicating that the key is operational and has the SDC programmed therein, and that it is ready to be used with a security device.

In summary, key 1 provides a programmable or smart key that receives a randomly generated SDC from a programming station unique to an individual retail store, and stores it in an internal memory, in combination with a timer which after a preset period of time will delete the SDC from the memory rendering the key inoperable, and which includes a wireless communication circuit preferably IR or RF, for receiving the SDC from a programming station and for supplying the SDC to a control logic circuit built into a security device. This enables the key to actuate the security device such as disarming an internal alarm, operating a locking mechanism or the like. Furthermore, the key contains an internal counter which counts the number of times the key is activated, either in conjunction with the SDC programmer or a security device, to ensure that the battery has sufficient power to properly maintain the functions of the key.

Furthermore, the logic control circuit of the programming station upon reading an SDC from a smart key different from the unique SDC stored in the program station will immediately time-out the usable time period in the key rendering it useless. This prevents a thief from using a programmed key from one store in the programming station of another store even if the key has yet to be timed out.

Although the above description refers to the security code being a disarm code, it is understood that the code can activate and control other functions and features of the security device such as unlocking the device from the product, shutting off an alarm etc. without departing from the concept of the invention. Likewise, the various components of the logic circuit and resulting flow charts can easily be modified by one skilled in the art to achieve the same results. Also, the security code can be preset in programming station at the factory or chosen by the customer, and if desired, be changed later by the customer, also without affecting the concept of the invention.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A programmable key for use in a security system for protecting items of merchandise, said key comprising:

a) a housing;

b) a power supply mounted in the housing; and c) a logic control circuit including a controller, a wireless communication circuit and a security code memory mounted in the housing and operably connected to the power supply by a control switch, said controller initially receiving a security code from a remote source through the wireless communication circuit for storage in the security code memory and for subsequent transmission of said security code by the wireless communication circuit to a security device adapted to be attached to an item of merchandise upon actuation of the control switch.

2. The programmable key defined in claim 1 wherein a visual indicator is operably connected to the logic control circuit and provides a visual effect to indicate an operational state of the programmable key.

3. The programmable key defined in claim 2 wherein the visual indicator is an LED; and in which a light pipe is mounted on the housing and is associated with the LED to enhance the visual effect of the LED when actuated.

4. The programmable key defined in claim 1 including a timer which invalidates the stored security code if not refreshed by the remote source within a certain time period.

5. The programmable key defined in claim 4 wherein the timer is reset to start when a valid security code is retransmitted to the control circuit by the remote source.

6. The programmable key defined in claim 1 including a counter which counts the number of activations of the control switch; and in which the counter permanently deactivates the control circuit upon reaching a certain count value.

7. The programmable key defined in claim 6 wherein the counter actuates an indicating signal a predetermined time period before permanently deactivating the control circuit.

8. The programmable key defined in claim 1 wherein the wireless communication circuit is an infrared (IR) circuit.

9. The programmable key defined in claim 8 wherein a visible light filter is mounted on the housing to enhance the transmission and reception of IR waves in the IR communication circuit.

10. The programmable key defined in claim 1 wherein the wireless communication circuit is a radio frequency (RF) circuit.

11. The programmable key defined in claim 1 wherein the power supply is a battery.

12. The programmable key defined in claim 1 wherein the housing is formed with an internal chamber and includes a flexible member in close proximity to the control switch which is mounted in the internal chamber for actuating said control switch.

13. The programmable key defined in claim 1 wherein the logic control circuit is formed on a printed circuit board mounted within an internal chamber of the housing.

14. A security system for protecting an object comprising:

a key operated security device for attachment to the object, said security device containing a first security code;

a key programmed with a second security code to actuate the security device when placed in proximity thereto;

a first communication system operable for effecting communication between the key and the security device for enabling the comparison of the second security code of the key to the first security code of the security device;

a remote programming station containing a second communication system operable for effecting communication between the programming station and the key, said remote programming station randomly generating the second security code and programming the second security code in the key using the second communication system; and a timer in the key for automatically invalidating the second security code after a predetermined time period.

15. The security system defined in claim 14 wherein the second communication system uses infrared (IR) or radio frequency (RF) wavelengths for programming the key with the second security code.

16. A programmable key for use in a security system for protecting items of merchandise, said key comprising:

a) a housing;

b) a control circuit including a controller, a communication circuit and a security code memory mounted in the housing, said controller initially receiving a security code from a remote source through the communication circuit for storage in the security code memory and for subsequent transmission of said security code by the communication circuit to a security device adapted to be attached to an item of merchandise; and c) a power source in the housing for powering the control circuit and a control switch for effecting the transfer of the security code from the remote source to the security code memory.

17. The programmable key defined in claim 16 including a counter which counts the number of activations of the control switch and which deactivates the control circuit upon reaching a certain count value.

18. The programmable key defined in claim 16 including a timer which inactivates the security code stored in the security code memory after a certain time period.

* * * * *